United States Patent [19]

Andersson

[11] 4,312,492

[45] Jan. 26, 1982

[54] ARRANGEMENT IN SLIPFORMS

[75] Inventor: Allan Andersson, Vellinge, Sweden

[73] Assignee: Interform Brödrene Pedersen AB, Vellinge, Sweden

[21] Appl. No.: 195,764

[22] Filed: Oct. 10, 1980

[30] Foreign Application Priority Data

Oct. 12, 1979 [SE] Sweden ..... 7908487

[51] Int. Cl.[3] ..... E04G 11/22; E04G 13/02

[52] U.S. Cl. ..... 249/20; 249/48; 264/33; 425/63

[58] Field of Search ..... 249/48, 20, 21; 264/34, 264/33; 425/63, 64

[56] References Cited

U.S. PATENT DOCUMENTS

| | | | |
|---|---|---|---|
| 3,510,098 | 5/1970 | Fox | 425/63 X |
| 3,593,392 | 7/1971 | Lambertini | 249/48 X |
| 4,014,633 | 5/1977 | Goughnour | 425/63 |

FOREIGN PATENT DOCUMENTS 351884 12/1972 Sweden .

*Primary Examiner*—Philip Anderson

*Attorney, Agent, or Firm*—Fleit & Jacobson

[57] ABSTRACT

In a slipform arrangement comprising a plurality of oblong, substantially rectangular mold plates arranged sequentially in a manner such that their end portions overlap each other there is provided an elongate post-like mold plate support means adjacent a short edge of an associated mold plate such as to support said plate in spaced relationship therewith, thereby to leave a gap for accommodating an end portion of a sequential mold plate, and tensioning means for creating in the region of said short edge a tensioning force directed substantially in the long direction of the post-like mold support. That part of the mold plate located nearest said short edge can be slightly angled towards the mold plate support means.

7 Claims, 3 Drawing Figures

ARRANGEMENT IN SLIPFORMS

Figure 1:
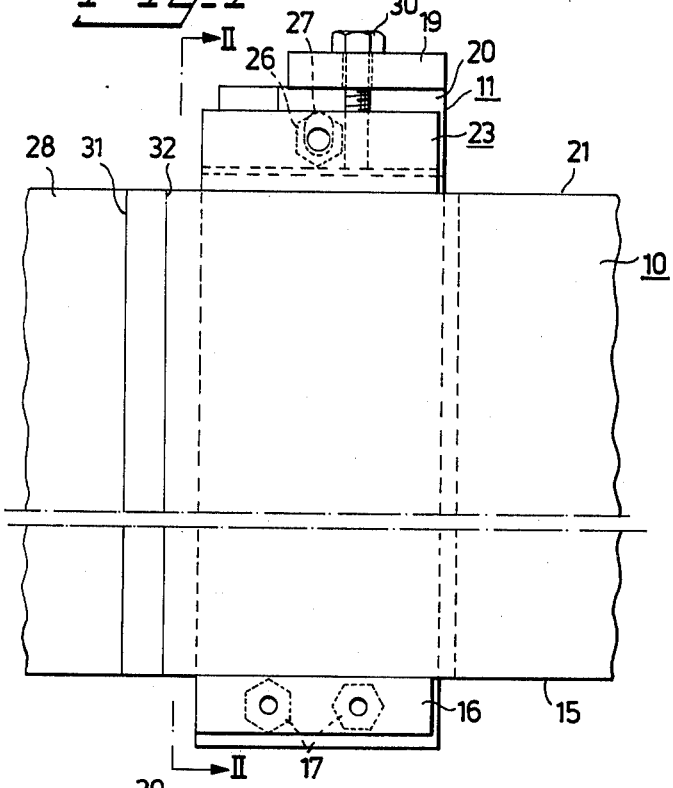

The present invention relates to a slipform arrangement comprising a plurality of oblong, substantially rectangular mold plates arranged sequentially in a manner such that their end portions overlap each other.

In slipform systems in which the actual form or mold is formed of a plurality of plates which are arranged sequentially around the circumference of the mold and which overlap each other at their end regions, there is a risk of concrete entering the overlapping parts of adjacent plates and forcing the end-edge region of the inner mold plate from the outer mold plate. This results in the formation of stripes or grooves in the cast concrete structure, which extend in the slip direction of the mold and which impair the aesthetic appearance of the cast structure. Moreover, in the worst of cases, the formation of these stripes or grooves may cause the reinforcing elements of the concrete structure to lie, in places, too close to the surface thereof, such that the reinforcing iron rods may corrode. The aforementioned problem is particularly acute when erecting concrete structures whose circumference varies along their height, the erection of which structures is possible with slipform systems of, for example, the kind illustrated in Swedish Patent Specification No. 351 884. The problem can also occur, however, in other slipforms of the kind described in the introduction, for example as a result of carelessness when vibrating concrete newly charged to the mold.

An object of the invention is to provide an inexpensive and readily operated arrangement with which the aforementioned problem is at least substantially overcome.

To this end it is proposed in accordance with the invention that in an arrangement of the kind described in the introduction there is provided an elongate post-like mold plate support means adjacent a short edge of an associated mold plate such as to support said plate in spaced relationship therewith, thereby to leave a gap for accommodating an end portion of a sequential mold plate, and tensioning means for creating in the region of said short edge a tensioning force directed substantially in the long direction of the post-like mold plate support means.

In accordance with a further development of the invention, the part of the mold plate located nearest said short edge is slightly angled towards the mold plate support means, said angle preferably being from about 5° to 10°. In this way, the effect obtained when applying the tensioning force is further increased.

The invention can be realized in a particularly simple and advantageous manner, by joining the mold plate adjacent at least one long edge thereof to the mold plate support means by means of a connection which permits the mold plate to be displaced relative to the mold plate support means in the longitudinal direction of said support means; and by providing the tensioning means with a bolt or clamp joint which acts between two lateral projections fixedly connected to the mold plate support means and to the mold plate respectively adjacent said long edge.

Figure 2:
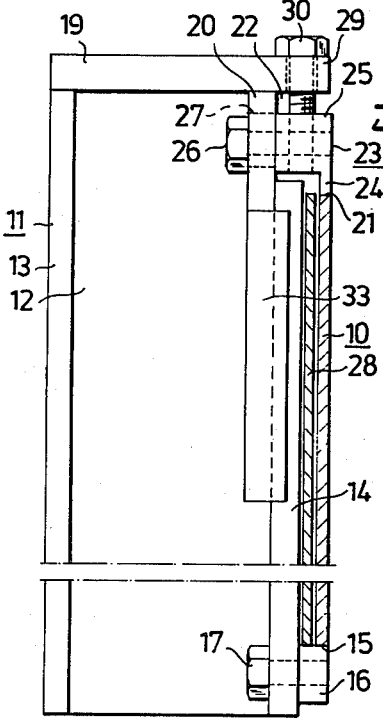
Figure 3:
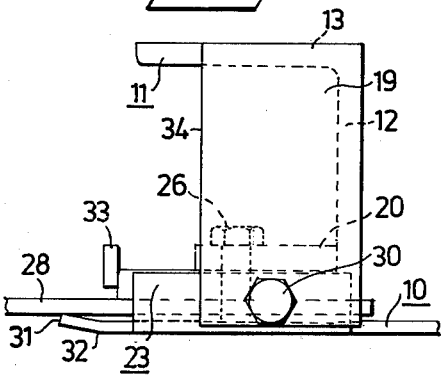

The invention will now be described in more detail with reference to the accompanying drawing, in which FIG. 1 is a side view, illustrating an end part of a preferred embodiment of the arrangement according to the invention, FIG. 2 is a sectional view taken on the line II—II of FIG. 1, and FIG. 3 is a top plan view of the arrangement illustrated in FIGS. 1 and 2.

The slipform plate arrangement illustrated in FIGS. 1 to 3 includes a partially illustrated, rectangular mold plate 10 and a post-like mold plate support means 11, the centre parts of the mold plate 10 and the support means 11 having been omitted from the Figure. In practice, the plate 10 can have a thickness of about 2.5–6 mm, a height of about 1–1.2 m, and a length of 2–5 m, whereat, as illustrated, the length of the support means 11, measured vertically, is somewhat greater than the height of the mold plate 10.

The support means 11 is of U-shaped cross-section, having a web of cross-piece 12 and flanges or legs 13, 14. The illustrated support means 11 is intended to be carried in a slipform system in which the mold plate arrangement is to be incorporated by a yoke leg (not shown) in a manner to permit a greater or lesser degree of adjustment. An arrangement for carrying a mold plate support means in a manner to permit universal adjustment is illustrated and described, for example in Swedish Patent Specification No. 351 884. Alternatively, the mold plate support means can be arranged to be rigidly carried by a yoke leg, or may form an integral part of a yoke leg, when the slipform system in which the mold plate support means is to be incorporated is intended for a use which permits such installation or design of the mold plate support means.

Firmly connected to the lower edge 15 of the mold plate 10, adjacent the end thereof, is a block 16, which is rigidly connected to the lower end of the support means 11 by means of screws 17. The heads of the screws 17 lie against the inside of the leg 14, while the screw-threaded shaft portions of the screws extend through holes in the leg 14 for axial movement in said holes, and are screwed in screw-threaded holes in the block 16. That side of the block which, when the mold plate arrangement is mounted in a slipform system, faces a concrete-receiving cavity, is located in the same plane as the surface of the mold plate 10 remote from the support means 11, while the block 16, on the opposite side, projects out towards the support means 11.

The upper end of the support means 11 is covered by a relatively thick cover plate 19 which projects laterally beyond the leg 14, but which terminates short of the free ends of the legs 13, 14. The leg 14 terminates at a distance from the plate 19. Arranged inwardly of the leg 14 is an insert 20 which is rigidly connected with the leg 14, the cross-piece 12 and the plate 19 so as to form between the upper edge of the leg 14 and the plate 19 a groove or channel 22 (FIG. 2) which extends in the direction of the upper mold plate edge 21, the bottom of which groove is formed by the insert 20.

Fixedly connected to the upper edge 21 of the mold plate 10 is an element 23 having a part 24 which forms an upwardly extending continuation of the plate 10, and a part or block 25 which is connected to the upper edge of part 24 and which is accommodated in the groove 22. The block 25 is held in abutment with the insert 20 forming the bottom of groove 22 by means of a screw 26 whose head lies against the inside of the insert 20 and whose screw-threaded shank portion passes through a slot-like opening 27 in the insert 20 for axial movement in said opening and meshes with a screw-threaded laterally directed hole in the block 25. As illustrated, the opening 27 is so formed that the block 25 can move in at least the longitudinal direction of the support means 11 while lying against the bottom of the groove 22.

The outer surface of the leg 14 defines, together with the surface of the mold plate facing theretowards, the element 23 and the block 16, a gap for receiving an end part of a further rectangular mold plate 28 located adjacent the mold plate 10, in a manner such that the mold plates 10, 28 can be displaced relative to one another substantially in the direction of the long edges 15, 21, with the mutually facing surfaces of the mold plates lying against one another or close to one another.

To prevent concrete from entering between the mold plates 10, 28, thereby to cause the mold plate 10 to bulge outwardly from the support means 11 with the deleterious results mentioned in the introduction, there acts between the block 25 and the block 29 formed by the part of the cover plate 19 projecting beyond the insert 20, a screw 30 whose head lies against the upper side of the cover plate 19 and whose screw-threaded shank portion passes through a hole in the block 29 for axial movement in said hole, and meshes with a screw-threaded hole formed in the block 25 and extending in the longitudinal direction of the support means. When tightening the screw 30, there is created in the mold plate 10, adjacent its end edge 31, a tension force which acts in the longitudinal direction of the support means 11 and which counteracts the outward bulging of the end-edge region of the mold plate away from the support means 11 and the plane of the mold plate 28. A suitable tensioning force with plates of the aforementioned dimensions is about 1 to 3 tons. This favourable effect can be further enhanced by slightly angling the mold plate 10, from a location 32 close to said end edge, towards the support means 11, in the manner shown in FIG. 3. The angle at which the end-edge region of the mold plate is angled is suitably about 5°–10°, within which range said favourable effect can be enhanced without appreciably affecting the ability of the mold plates 10, 28 to move relative to one another in the circumferential direction of the slip form.

Fixedly mounted on the free edge of the leg 14, close to the upper end of the form support means 11, is a rectangular element 33 which serves to retain a substantially U-shaped stirrup structure (not shown) between itself and the edge 34 of the plate 19, said stirrup structure being arranged, in a known manner, to grip around the upper part of the leg 14 and the mold plate 10 so as to enable the mold plate 10 and the support means 11 to be localized correctly relative to one another.

The above described embodiment illustrated in the drawing is not limitive of the invention, but can be modified within the scope of the following claims.

I claim:

1. In a slipform arrangement comprising a plurality of oblong, substantially rectangular mold plates arranged sequentially in a manner such that their end portions overlap each other there is provided an elongate post-like mold plate support means adjacent a short edge of an associated mold plate such as to support said plate in spaced relationship therewith, thereby to leave a gap for accommodating an end portion of a sequential mold plate, and tensioning means for creating in the region of said short edge a tensioning force directed substantially in the long direction of the post-like mold plate support.

2. A slipform arrangement according to claim 1, wherein that part of the mold plate located nearest said short edge is slightly angled towards the mold plate support means.

3. A slipform arrangement according to claim 2, wherein said part of the mold plate is angled at about 5° to 10°.

4. A slipform arrangement according to claim 1, 2 or 3, wherein the mold plate is joined, adjacent at least one long edge thereof, to the mold plate support means by means of a connection which permits the mold plate to move relative to the mold plate support means in the longitudinal direction of said support means; and wherein said tensioning means for creating said tensioning force includes a bolt or clamp joint which acts between two lateral projections fixedly connected respectively to the mold plate support means and said mold plate adjacent said long edge.

5. A slipform arrangement comprising:

(a) a plurality of oblong, substantially rectangular mold plates having first and second longitudinally-extending side edges, each of said plates having:
  (1) a block rigidly connected to the first side edge of the plate adjacent one end thereof, and
  (2) an element fixedly connected to the second side edge of the plate adjacent the one end thereof; and (b) elongate post-like mold plate support means for holding the mold plates arranged sequentially such that end portions of the plates overlap each other, comprising:
  (1) a support of U-shaped cross-section having legs interconnected by a web,
  (2) first means carried by said support and engageable with said block, and second means carried by said support and engageable with said element, said first and said second means holding said one end of said plate spaced from an outer surface of one of said legs so that a gap is defined between the one end of said plate an said leg, an end portion of an adjacent plate being positionable in said gap, and
  (3) tensioning means carried by said support and engageable with said second means for exerting a tension force acting on said one end of said plate in a direction substantially perpendicular to the side edges thereof.

6. A slipform arrangement according to claim 5, wherein said block and said element are spaced from said one end of said plate, and wherein the plate is angled towards said mold plate support means in a region located between said one end and a region containing the block and element.

7. A slipform arrangement according to claim 6, wherein the angle is between 5° and 10°.

* * * * *